US006154626A

United States Patent [19]

Litman et al.

[11] Patent Number: 6,154,626

[45] Date of Patent: Nov. 28, 2000

[54] DEVELOPMENT ROLLER

[75] Inventors: Alan M. Litman; Jorge A. Alvarez, both of Webster; Jerome P. Chasko, Williamson, all of N.Y.

[73] Assignee: Xerox Corporation, Stamford, Conn.

[21] Appl. No.: 09/186,091

[22] Filed: Nov. 5, 1998

[51] Int. Cl.[7] ..... G03G 15/08

[52] U.S. Cl. ..... 399/282; 399/291; 492/45

[58] Field of Search ..... 399/286, 266, 399/290–293; 492/18, 28, 53, 54, 45, 46; 427/58, 261

[56] References Cited

U.S. PATENT DOCUMENTS

| | | | |
|---|---|---|---|
| 344,403 | 6/1886 | Holloway | 492/46 |
| 1,636,492 | 7/1927 | Taylor | 492/45 X |
| 1,718,415 | 6/1929 | Gowans | 492/45 |
| 3,830,199 | 8/1974 | Saito et al. | 118/637 |
| 3,965,853 | 6/1976 | Moser | 118/60 |
| 4,776,070 | 10/1988 | Shibata et al. | 29/130 |
| 4,864,343 | 9/1989 | Nelson | 354/304 |
| 4,868,600 | 9/1989 | Hays et al. | 355/259 |
| 4,884,110 | 11/1989 | Tsurubuchi et al. | 355/319 |
| 4,892,696 | 1/1990 | Murakami et al. | 264/219 |
| 4,984,019 | 1/1991 | Folkins | 355/215 |
| 5,010,367 | 4/1991 | Hays | 355/247 |
| 5,063,875 | 11/1991 | Folkins et al. | 118/651 |
| 5,194,050 | 3/1993 | Muraishi et al. | 474/101 |
| 5,195,430 | 3/1993 | Rise | 100/168 |
| 5,384,627 | 1/1995 | Behe et al. | 399/291 |
| 5,413,807 | 5/1995 | Duggan et al. | 427/58 |
| 5,470,471 | 11/1995 | Luthi et al. | 210/386 |
| 5,473,418 | 12/1995 | Kazakos et al. | 355/259 |

*Primary Examiner*—Quana Grainger
*Attorney, Agent, or Firm*—Andrew D. Ryan

[57] ABSTRACT

A development roller for use in a machine in which marking particles are advanced toward a latent image to form a developed image is provided. The development roller includes a conductive body. The conductive body includes a central portion, a peripheral portion spaced from the central portion, and a support structure interconnecting the peripheral portion to the central portion. The development roller also includes a semiconductive material applied to an outer periphery of the conductive body.

25 Claims, 5 Drawing Sheets

DEVELOPMENT ROLLER

This invention relates generally to a development apparatus used in ionographic or electrophotographic imaging and printing apparatuses and machines, and more particularly is directed to donor roll substrates for a development system.

One common element utilized in machinery is a roll. The roll typically includes a body and two journals or stems which extend outwardly from opposed ends of the body. Bearings, either in the form of journal or rolling element bearings, permit for the rotatable mounting of the rolls onto a frame of the machinery. The bearings are typically mounted to the outer periphery of the journals of the roll. These rolls, particularly those for use in precision equipment, may be expensive and difficult to manufacture. One particular type of machinery that utilizes rolls to a great extent is that of a printing machine. In a printing machine, a substrate typically in the form of a paper roll or cut paper sheets are fed through various steps in the printing process. The substrate is guided along a paper path by rolls and processing steps are often applied to the substrate through the use of rolls.

Generally, the process of electrophotographic printing includes charging a photoconductive member to a substantially uniform potential so as to sensitize the surface thereof. The charged portion of the photoconductive surface is exposed to a light image from either a scanning laser beam or an original document being reproduced. This records an electrostatic latent image on the photoconductive surface. After the electrostatic latent image is recorded on the photoconductive surface, the latent image is developed. Two component and single component developer materials are commonly used for development. A typical two component developer comprises magnetic carrier granules having toner particles adhering triboelectrically thereto. A single component developer material typically comprises toner particles. Toner particles are attracted to the latent image forming a toner powder image on the photoconductive surface, the toner powder image is subsequently transferred to a copy sheet, and finally, the toner powder image is heated to permanently fuse it to the copy sheet in image configuration.

The electrophotographic marking process given above can be modified to produce color images. One color electrophotographic marking process, called image-on-image processing, superimposes toner powder images of different color toners onto the photoreceptor prior to the transfer of the composite toner powder image onto the substrate. While the image on image process is beneficial, it has several problems. For example, when recharging the photoreceptor in preparation for creating another color toner powder image, it is important to level the voltages between the previously toned and the untoned areas of the photoreceptor. Moreover, the viability of printing system concepts such as image-on-image processing usually requires development systems that do not scavenge or interact with a previously developed image. Several known development systems, such as conventional magnetic brush development and jumping single component development, are interactive with the image bearing member, making them unsuitable for use with image-on-image processes.

One particular version of a scavengeless development system uses a plurality of electrode wires closely spaced from a toned donor roll. The donor roll is loaded with toner using conventional two component magnetic brush development. An AC voltage is applied to the wires to generate a toner cloud in the development zone. The electrostatic fields from the latent image attract toner from the toner cloud to develop the latent image.

Since hybrid scavengeless development relies on a continuous, steady toner powder cloud at the nip between the latent image and the donor roller, the speeds at which the rollers operate are significantly higher and the accuracy requirements are much more precise.

The purpose and function of scavengeless development are described more fully in, for example, U.S. Pat. No. 4,868,600 to Hays et al., U.S. Pat. No. 4,984,019 to Folkins, U.S. Pat. No. 5,010,367 to Hays, or U.S. Pat. No. 5,063,875 to Folkins et al, the relevant portions of these references are incorporated herein by reference.

For proper operation of a donor roll in a hybrid scavengeless development, the diameter tolerance, runout and surface finish requirements of the donor roll are very critical and require very precise dimensions. Furthermore, donor rolls typically have a long length and a small diameter. For example, donor rolls may have a length of, for example, 18 to 24 inches and a diameter from 1 to 1½ inches.

Precision rolls, whether for use as a donor roll or for another purpose, are typically made by machining a body from a solid cylindrical stock. To provide for journals at opposing ends of the rolls, typically a hole or counterbore is machined in each of the opposed faces of the cylindrical body. Journals are machined from smaller cylindrical stock and are cut to length and fitted into the counterbored apertures in the opposed ends of the cylindrical body.

The processes of counterboring a solid body, of machining cylindrical journals and of inserting the cylindrical journals into the body have several major disadvantages, particularly when used to manufacture a large quantity of high-quality, precision rolls.

Precision rolls, such as those for a donor roll, require a outer periphery that has precision size, roundness and runout requirements with respect to the journals to which bearings are mounted to provide for rotation of the roll. As the roll is rotated about the journals of the roll, the outer periphery of the roll may have an eccentric pattern or runout with respect to the mounting journals. For the proper operation of a donor roll, the runout requirements may be as precise as to be within 0.000,025 meters (25 microns). Obtaining such a low runout is very difficult when utilizing the process steps of counterboring of the body and inserting journals in the counterbores.

Runout measured between the solid body periphery and the counterbore inside diameter must be added to the roundness measured of the solid body as well as to the roundness measured of the journals to accumulate the runout of the assembled roll.

Attempts to reduce the runout from this process include subsequent machining or grinding of the outer periphery of the body while rotating the body about the assembled journals. This additional machine step adds cost to the manufacturing of the donor rolls.

In addition to the increased difficulty in obtaining a precision roll from the prior art process of an assembled roll, the use of an assembled roll is very expensive. For example, not only must a solid cylindrical body be purchased but the journals must be separately procured. Further, the counterbores on the ends of the solid body must be machined. Further, the journals must be accurately machined to fit the bores on the solid body. Also the journals must be assembled into the bores by the use of an appropriate technique, such as press fitting or shrink fitting the journals within the bores.

In addition to the cost and difficulty in manufacturing such an assembled roll, the use of an assembled roll can cause quality problems in that if the press fit process or the shrink fit process is not properly performed, the solid body may become loose from the journals requiring the replacement of the roll.

The roll substrate of the present invention is intended to alleviate at least some of the above-mentioned problems.

The following disclosures may be relevant to various aspects of the present invention:

U.S. Pat. No. 5,473,418
Inventor: Kazakos et al.
Issue Date: Dec. 5, 1995

U.S. Pat. No. 5,413,807
Inventor: Duggan et al.
Issue Date: May 9, 1995

U.S. Pat. No. 5,195,430
Inventor: Rise
Issue Date: Mar. 23, 1993

U.S. Pat. No. 5,194,050
Inventor: Muraishi et al.
Issue Date: Mar. 16, 1993

U.S. Pat. No. 5,063,875
Inventor: Folkins et al.
Issue Date: Nov. 12, 1991

U.S. Pat. No. 5,010,367
Inventor: Hays
Issue Date: Apr. 23, 1991

U.S. Pat. No. 4,984,019
Inventor: Folkins
Issue Date: Jan. 8, 1991

U.S. Pat. No. 4,892,696
Inventor: Murakami et al.
Issue Date: Jan. 9, 1990

U.S. Pat. No. 4,884,110
Inventor: Tsurubachi et al.
Issue Date: Nov. 28, 1989

U.S. Pat. No. 4,868,600
Inventor: Hays et al.
Issue Date: Sep. 19, 1989

U.S. Pat. No. 4,864,343
Inventor: Nelson
Issue Date: Sep. 5, 1989

U.S. Pat. No. 4,776,070
Inventor: Shibata et al.
Issue Date: Oct. 11,1988

U.S. Pat. No. 3,965,853
Inventor: Moser
Issue Date: Jun. 29, 1976

U.S. Pat. No. 3,830,199
Inventor: Saito et al.
Issue Date: Aug. 20, 1974

The relevant portions of the foregoing disclosures may be briefly summarized as follows:

U.S. Pat. No. 5,473,418 discloses a donor roll having a ceramic coating for use with an electrode structure in a scavangeless development unit of an electrostatographic printer. The ceramic coating consists essentially of a suitable mixture of alumina and titania by weight giving the donor roll a desired resistivity.

U.S. Pat. No. 5,413,807 discloses a method of manufacturing a donor roll having a plurality of electrodes on the surface of the roll. The roll is for use in developing a latent image. The method includes providing a substantially cylindrical member and covering at least a portion of the surface of the member tangentially with a screen. The screen has an aperture therein. The method further includes urging a conductive material through at least a portion of the aperture and onto the surface of the member to form at least one of the electrodes and advancing the screen and the surface of the member synchronously to form subsequent electrodes.

U.S. Pat. No. 5,195,430 discloses a fixing and developing apparatus in which sheet material to be treated is passed through a high pressure nip defined by a pair of rollers. At least one of the rollers may have a composite construction. The composite roller includes an elongated tubular shell with a pressure applying external surface, an elongated core positioned within the tubular shell, and an elastomeric material disposed between the core and shell to support the shell on the core. The core may be of a number of configurations and may increase in transverse cross-sectional dimension from the respective ends of the core toward the center of the core. The core may taper continuously or in discrete steps from its center toward its first and second ends. In addition, the core may have a longitudinal cross-section with a crown in the shape of a beam deflection curve for a simply supported, uniformly constant cross-section beam. The shell may be similarly configured along its interior surface. Also, the elastomer may be compressed at the center of the roller relative to the ends of the roller to preload its center portion.

U.S. Pat. No. 5,194,050 discloses a positioning device for preventing an endless belt passed over a plurality support rollers from being shifted to either of opposite sides in the axial direction of the rollers. A pair of forcing elements are located at both ends of at least one of the support rollers for forcing back, when the belt is shifted toward either of opposite ends of the support roller to contact the end of the latter, the belt toward the center of the roller in the axial direction of the roller. The forcing elements each are implemented as a plurality of spaced flanges. The maximum diameter of the flanges sequentially increases from the innermost flange to the outermost flange in the axial direction of the roller. The plurality of flanges may be replaced with a single spiral flange.

U.S. Pat. No. 5,063,875 discloses an apparatus which develops an electrostatic latent image. A transport roll advances developer material from a chamber to a donor roll. The donor roll advances the toner particles to the latent image. The latent image attracts toner particles from the donor roll. In order to improve the speed with which toner particles removed from the donor roll are replaced, an alternating voltage is applied between the two rolls. The magnetic transport roll is driven to rotate at a surface velocity at least 2, but not more than 5 times that of the rotational surface velocity of the donor roll.

U.S. Pat. No. 5,010,367 discloses a scavengeless/non-interactive development system for use in highlight color imaging. To control the developability of lines and the degree of interaction between the toner and receiver, the combination of an AC voltage on a developer donor roll with an AC voltage between toner cloud forming wires and donor roll enables efficient detachment of toner from the donor to form a toner cloud and position one end of the cloud in close proximity to the image receiver for optimum development of lines and solid areas without scavenging a previously toned image.

U.S. Pat. No. 4,984,019 discloses an apparatus in which an contaminants are removed from an electrode positioned between a donor roller and a photoconductive surface. A magnetic roller is adapted to transport developer material to the donor roller. The electrode is vibrated to remove contaminants therefrom.

U.S. Pat. No. 4,892,696 discloses a method of manufacturing a rubber or plastic-coated roller such as a fixing roller to be used in the thermal fixing part of an electrophotographic copying machine. The method is directed to the production of the rubber or plastic-coated roller by placing a cylindrical mold upright, fitting into the lower part of the cylindrical mold a lower plug provided in the inside thereof with a tapered surface for guiding a core shaft and at the center thereof with a material injection hole, inserting into the cylindrical mold the core shaft having tapered surfaces one each the opposite ends thereof or the core shaft having tapered surface one each at the opposite ends thereof and covered with caps, fitting into the upper part of the cylindrical mold an upper plug provided in the inside thereof with a tapered surface for guiding the core shaft and at the center thereof with an air vent, injecting liquid rubber or plastic under pressure into the cylindrical mold via the material injection hole of the lower plug, and allowing the injected rubber or plastic to set. By this method, there is produced a coated roller the rubber or plastic layer of which is free from eccentricity, and requires no secondary fabrication such as polishing.

U.S. Pat. No. 4,884,110 discloses a sheet conveyance mechanism for a copying machine which allows an image to be copied on both sides of a sheet of paper. The sheet conveyance mechanism includes an intermediate tray in which the sheet is copied on one side thereof by an image copy section, a friction roller capable of effecting reversible rotation and a double feed preventing roller. In operation, a sheet of paper is conveyed by the friction roller into the intermediate tray in which an image is copied onto one side of the sheet, the sheet is then removed by the friction roller, rotating in the reverse direction and transported back to the intermediate tray in which an image is copied on the second side of the sheet.

U.S. Pat. No. 4,868,600 discloses a scavengeless development system in which toner detachment from a donor and the concomitant generation of a controlled powder cloud is obtained by AC electric fields supplied by self-spaced electrode structures positioned within the development nip. The electrode structure is placed in close proximity to the toned donor within the gap between the toned donor and image receiver, self-spacing being effected via the toner on the donor. Such spacing enables the creation of relatively large electrostatic fields without risk of air breakdown.

U.S. Pat. No. 4,864,343 discloses a pressure roll is disclosed particularly for fixing and developing sheet material which is treated by passing through a high pressure nip defined by a pair of the rolls. The roll includes a support shaft and a cylindrical roll body secured to the shaft. To produce a uniform force along the pressure nip when a pair of the rolls are placed under load, the body is formed from a body material having a modulus of elasticity which varies as a function of position along the length of said body. The body is encased in a cylindrical shell.

U.S. Pat. No. 4,776,070 discloses a roller which has a roller body having a small electrical resistivity, a bonding layer formed substantially uniformly on the outer peripheral surface of the roller body, a lower insulating layer provided on the bonding layer; a heat generating layer provided on the lower insulating layer and a ceramic matrix and a metallic resistance layer, constituted by a metal dispersed in the ceramic matrix. The metallic resistance layer extends substantially continuously in the lengthwise direction of the roller, a heat generating layer. The roller has an upper insulating layer provided on the heat generating layer, a protective layer formed on the upper insulating layer so as to prevent offset of the toner images, an electrode layer formed on each end of the roller and adapted to connect the heat generating layer to an external power source; and side protective layers covering at least the side surface of the heat generating layer, and the side surfaces and the axially outside surfaces of the lower insulating layer.

U.S. Pat. No. 3,965,853 discloses contact fuser assembly for use in an electrostatic reproducing apparatus including an internally heated fuser roll structure comprising a rigid or non-deformable, thermally conductive core capable of interacting with a material applied thereto in such a manner as to form a thermally-stable interfacial coating intermediate the surface of the core and a release coating also formed thereon. The interfacial coating strongly adheres to the core surface and prevents toner material from contacting the outer surface of the core. The combined coatings have a sub-micron thickness and therefore present a minimal thermal barrier to the energy being conducted outwardly by the core. The fuser assembly is characterized by the provision of means for controlling the interaction between the core and the material.

U.S. Pat. No. 3,830,199 discloses a device provided with a developing roller formed on its periphery with a multitude of valleys and valley, with the crests serving as fluid containing sections which are supplied with a developing fluid. The device is also provided with a doctor member made of a resilient, fluid absorbing material and adapted to adjust the level of the fluid contained in each fluid containing section such that the fluid is maintained at a level below the crests, or the maximum diameter portions of the developing roller. A recording sheet on which an electrostatic image is formed is brought into contact with the developing roller so that the fluid contained in the fluid containing sections selectively adheres to the electrostatic image to render the image visible. The visible images produced by this method may vary in density depending on the quantities of electricity carried by the charged regions of the electrostatic images.

SUMMARY OF THE INVENTION

In accordance with one aspect of the present invention, there is provided a development roller for use in a machine in which marking particles are advanced toward a latent image to form a developed image. The development roller includes a conductive body. The conductive body includes a central portion, a peripheral portion spaced from the central portion, and a support structure interconnecting the peripheral portion to the central portion. The development roller also includes a semiconductive material applied to an outer periphery of the conductive body.

In accordance with another aspect of the present invention, there is provided a development unit for use in a printing machine in which marking particles are advanced toward a latent image to form a developed image. The development unit includes a housing defining a chamber therein for storing a supply of marking particles therein. The housing defines an aperture therein and a development roller. The roller is rotatably mounted to the housing and positioned adjacent the aperture. The development roller is adapted to advance the marking particles from the chamber toward the latent image. The development roller includes a conductive body. The conductive body includes a central portion, a peripheral portion spaced from the central portion, and a support structure. The support structure interconnects the peripheral portion to the central portion. The development roller also including a semiconductive material applied to an outer periphery of the conductive body.

In accordance with yet another aspect of the present invention, there is provided an electrophotographic printing machine of the type in which marking particles are advanced toward a latent image to form a developed image. The printing machine includes a development unit. The development unit includes a housing defining a chamber therein for storing a supply of marking particles therein. The housing defines an aperture therein and a development roller. The roller is rotatably mounted to the housing and positioned adjacent the aperture. The development roller is adapted to advance the marking particles from the chamber toward the latent image. The development roller includes a conductive body. The conductive body includes a central portion, a peripheral portion spaced from the central portion, and a support structure. The support structure interconnects the peripheral portion to the central portion. The development roller also including a semiconductive material applied to an outer periphery of the conductive body.

In accordance with still another aspect of the present invention, there is provided a development roller for use in a machine in which marking particles are advanced toward a latent image to form a developed image. The development roller includes a conductive body. The body has a uniform cross section and is made from an extruded material. The conductive body includes a central portion having a generally cylindrical shape. The conductive body also includes a peripheral portion spaced from the central portion and a support structure. The support structure interconnects the peripheral portion to the central portion. The support structure has a one piece construction. The support structure includes three equally spaced apart ribs. Each rib has a similar uniform width. The central portion of the conductive body extends outwardly from opposed ends of the peripheral portion of the conductive body. The development roller also includes a semiconductive material applied to an outer periphery of the conductive body. The semiconductive material includes at least one of a ceramic, a plastic and an anodized material.

Inasmuch as the art of electrophotographic printing is well known, the various processing stations employed in the printing machine will be shown hereinafter schematically and their operation described briefly with reference thereto.

Figure 5:
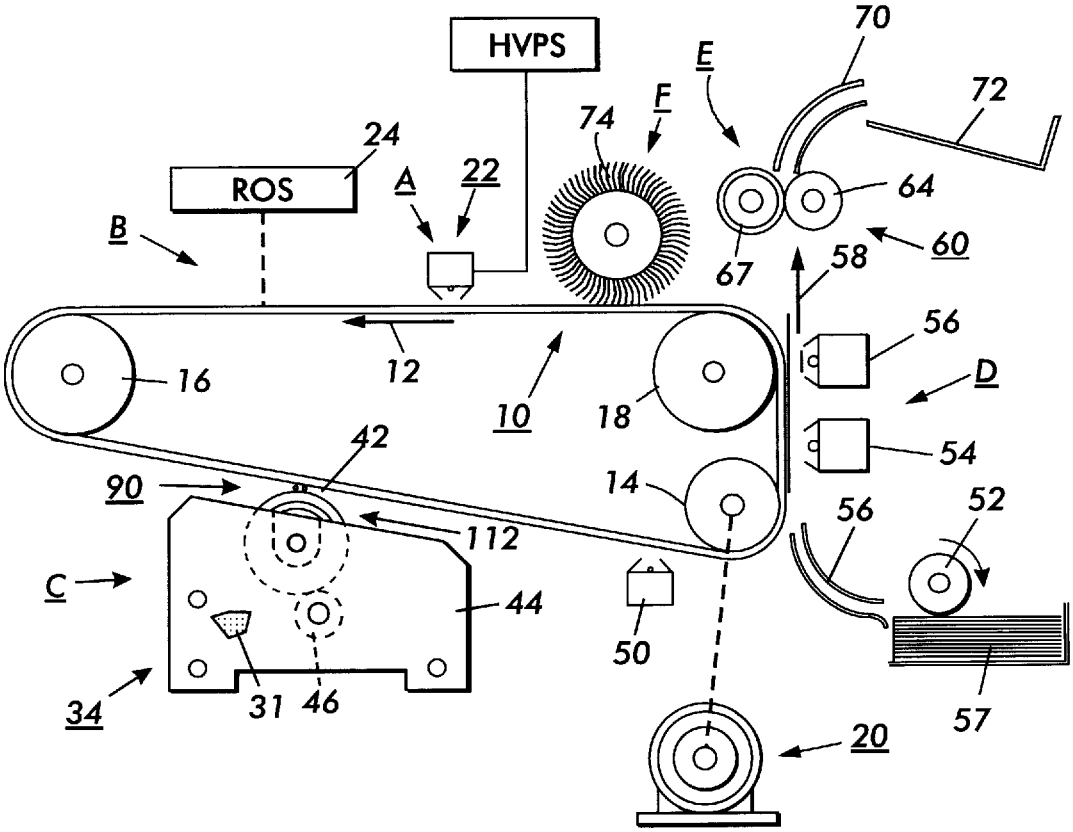
FIG. 5 is a schematic elevational view of an illustrative electrophotographic printing or imaging machine or apparatus incorporating a development apparatus having the features of the present invention therein.

Referring initially to FIG. 5, there is shown an illustrative electrophotographic machine having incorporated therein the donor roll of the present invention. An electrophotographic printing machine creates an image in a single pass through the machine and incorporates the features of the present invention. It should be appreciated that the present invention may be utilized in an electrophotographic printing machine which utilizes an image on image process to create a color image in a single pass through the machine. The printing machine uses a charge retentive surface in the form of an Active Matrix (AMAT) photoreceptor belt 10 which travels sequentially through various process stations in the direction indicated by the arrow 12. Belt travel is brought about by mounting the belt about a drive roller 14 and two tension rollers 16 and 18 and then rotating the drive roller 14 via a drive motor 20.

As the photoreceptor belt moves, each part of it passes through each of the subsequently described process stations. For convenience, a single section of the photoreceptor belt, referred to as the image area, is identified. The image area is that part of the photoreceptor belt which is to receive the toner powder images which, after being transferred to a substrate, produce the final image. While the photoreceptor belt may have numerous image areas, since each image area is processed in the same way, a description of the typical processing of one image area suffices to fully explain the operation of the printing machine.

As the photoreceptor belt 10 moves, the image area passes through a charging station A. At charging station A, a corona generating device, indicated generally by the reference numeral 22, charges the image area to a relatively high and substantially uniform potential. The device 22 is powered by a high voltage power supply (HVPS).

After passing through the charging station A, the now charged image area passes through an exposure station B. At exposure station B, the charged image area is exposed to light which illuminates the image area with a light representation of a black image. That light representation discharges some parts of the image area so as to create an electrostatic latent image. While the illustrated embodiment uses a laser based output scanning device 24 or raster output scanner (ROS) as a light source, it is to be understood that other light sources, for example an LED printbar, can also be used with the principles of the present invention. It should also be appreciated that the present invention may be practiced in a light lens machine in which an image is formed by passing light through an original document to expose the photoconductive surface.

After passing through the first exposure station B, the now exposed image area passes through a development station C. The development station C deposits an image, of negatively charged toner 31 onto the image area. That toner is attracted to the less negative sections of the image area and repelled by the more negative sections. The result is a first toner powder image on the image area.

The development station C, which incorporates a donor roll 42 in development system 34. Electrode grid 90 is electrically biased with an AC voltage relative to donor roll 42 for the purpose of detaching toner therefrom so as to form a toner powder cloud 112 in the gap between the donor roll and photoconductive surface. Both electrode grid 90 and donor roll are biased at a DC potential for discharge area development (DAD). The discharged photoreceptor image attracts toner particles from the toner powder cloud to form a toner powder image thereon.

After passing the corotron member 50, the toner powder image is transferred from the image area onto a support sheet 57 at transfer station D. It is to be understood that the support sheet is advanced to the transfer station in the direction 58 by a conventional sheet feeding apparatus which is not shown. The transfer station D includes a transfer corona device 54 which sprays positive ions onto the backside of sheet 57. This causes the negatively charged toner powder images to move onto the support sheet 57. The transfer station D also includes a detack corona device 56 which facilitates the removal of the support sheet 57 from the photoreceptor belt 10.

After transfer, the support sheet 57 moves onto a conveyor (not shown) which advances that sheet to a fusing station E. The fusing station E includes a fuser assembly, indicated generally by the reference numeral 60, which permanently affixes the transferred powder image to the support sheet 57. Preferably, the fuser assembly 60 includes a heated fuser roller 67 and a backup or pressure roller 64. When the support sheet 57 passes between the fuser roller 67 and the backup roller 64 the toner powder is permanently affixed to the sheet support 57. After fusing, a chute 70 guides the support sheets 57 to a catch tray 72 for removal by an operator.

After the support sheet 57 has separated from the photoreceptor belt 10, residual toner particles on the image area are removed at cleaning station F via a cleaning brush 74 contained in a housing (not shown). The image area is then ready to begin a new marking cycle.

The various machine functions described above are generally managed and regulated by a controller which provides electrical command signals for controlling the operations described above.

Figure 4:
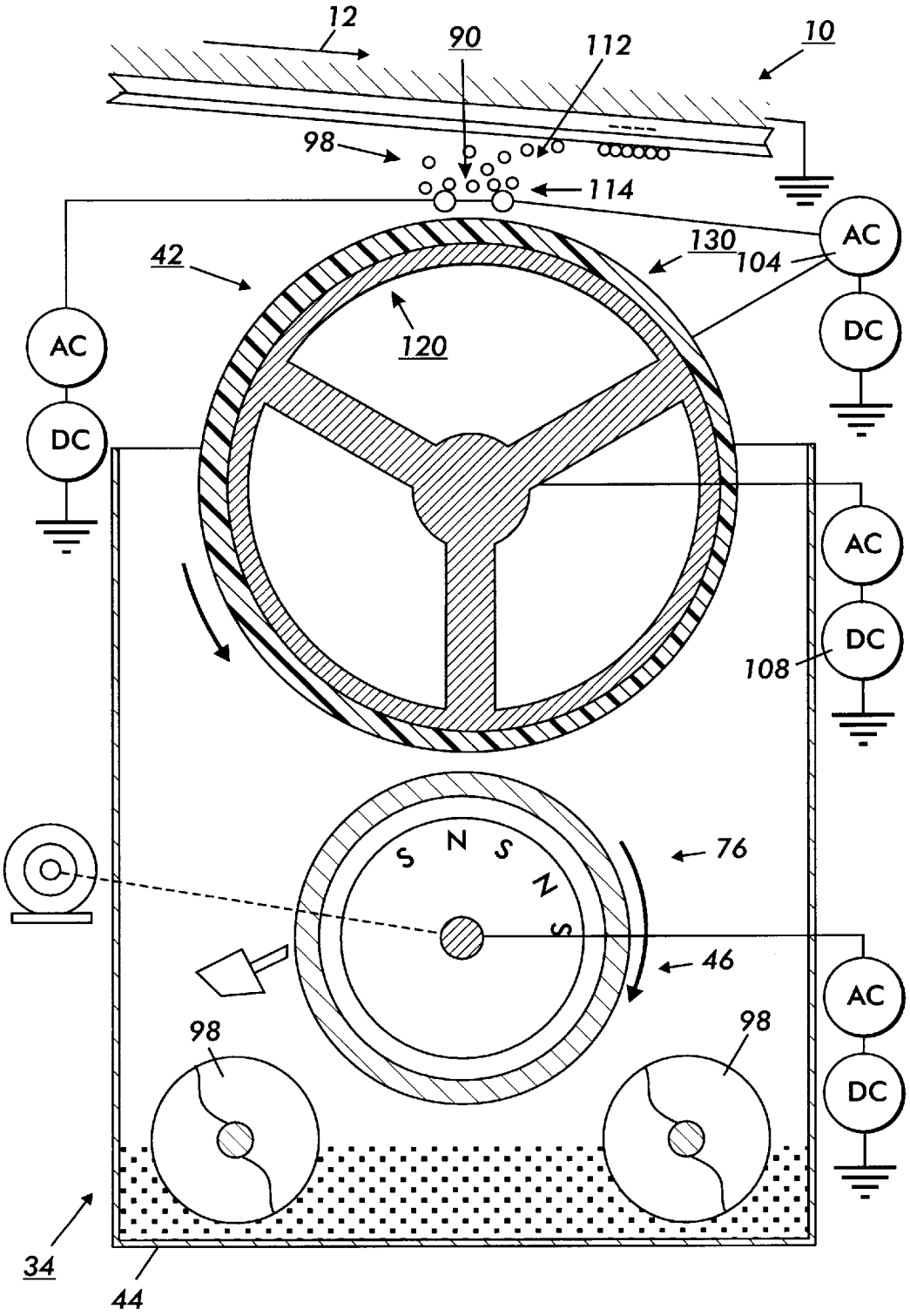
FIG. 4 is a schematic elevational view showing the development apparatus,used in the FIG. 5 printing machine.

Referring now to FIG. 4 in greater detail, the development system 34 is scavengeless, meaning that the developer or toner from system 34, which is delivered to development zone 114, must not interact significantly with an image already formed on the image receiver 10. Thus, the system 34 is also known as a non-interactive development system. The development system 34 comprises a donor structure in the form of a roller 42, which conveys a toner layer to the region under the wire assembly 90. The toner layer can be formed on the donor roll 42 by either a two component developer (i.e. toner and carrier) or a single component developer (toner only). The development zone contains an AC biased electrode structure 90 self-spaced from the donor roll 42 by the toner layer. The toner deposited on donor roll 42 may be positively or negatively charged. The donor roll 42 may be coated with a ceramic coating, or with TEFLON-S™ (trademark of E. I. duPont De Nemours) loaded with carbon black.

For donor roll loading with two component developer, a conventional magnetic brush 46 can be used for depositing the toner layer onto the donor structure, as illustrated in U.S. Pat. No. 4,868,600.

For single component loading of donor roll 42, the combination metering and charging device may comprise any suitable device for depositing a monolayer of well charged toner onto the donor structure 42. For example, it may comprise an apparatus such as described in U.S. Pat. No. 4,868,600 wherein the contact between weakly charged toner particles and a triboelectrically active coating contained on a charging roller results in well charged toner. Other combination metering and charging devices may be employed.

With continued reference to FIG. 4, augers, indicated generally by the reference numeral 98, are located in chamber 76 of housing 44. Augers 98 are mounted rotatably in chamber 76 to mix and transport developer material The augers have blades extending spirally outwardly from a shaft. The blades are designed to advance the developer material in the axial direction substantially parallel to the longitudinal axis of the shaft. As successive electrostatic latent images are developed, the toner particles within the developer material are depleted. A toner dispenser (not shown) stores a supply of toner particles. The toner dispenser is in communication with chamber 76 of housing 44. As the concentration of toner particles in the developer material is decreased, fresh toner particles are furnished to the developer material in the chamber from the toner dispenser. The augers in the chamber of the housing mix the fresh toner particles with the remaining developer material so that the resultant developer material therein is substantially uniform with the concentration of toner particles being optimized. In this manner, a substantially constant amount of toner particles are in the chamber of the developer housing with the toner particles having a constant charge.

The electrode structure 90 is comprised of one or more thin (i.e. 50 to 100 micron ($\mu$m) diameter) tungsten or stainless steel wires which are lightly positioned against the toner on the donor structure 42. The distance between the wires and the donor is self-spaced by the thickness of the toner layer which is approximately 25 micron ($\mu$m). The extremities of the wires are supported by end blocks (not shown) at points slightly below a tangent to the donor roll surface. Mounting the wires in such manner makes the self-spacing insensitive to roll runout. A suitable scavengeless development system for incorporation in the present invention is disclosed in U.S. Pat. No. 4,868,600. As disclosed in the '600 patent, a scavengeless development system may be conditioned to selectively develop one or the other of the two image areas (i.e., discharged and charged image areas) of the images by the application of appropriate AC and DC voltage biases to the wires in electrode structure 90 and the donor roll structure 42.

An AC power source 104 applies an electrical bias of, for example, 1000 volts peak-to-peak at 4 kHz between the electrode structure 90 and the donor roll 42. A DC bias from 0 to −400 volts is applied by a DC power source 108 to the donor roll 42. The AC voltage applied between the set of wires 90 and the donor structure 42 establishes AC fringe fields serving to liberate toner particles from the surface of the donor structure 42 to form the toner cloud 112 in the development zone 114. The electric field which exists in the development zone 114, due to the electrostatic image, the charged toner layer on the donor roll and the voltages applied to the electrode structure 90 and the donor roll 42, controls the deposition of toner onto the image receiver.

Figure 1:
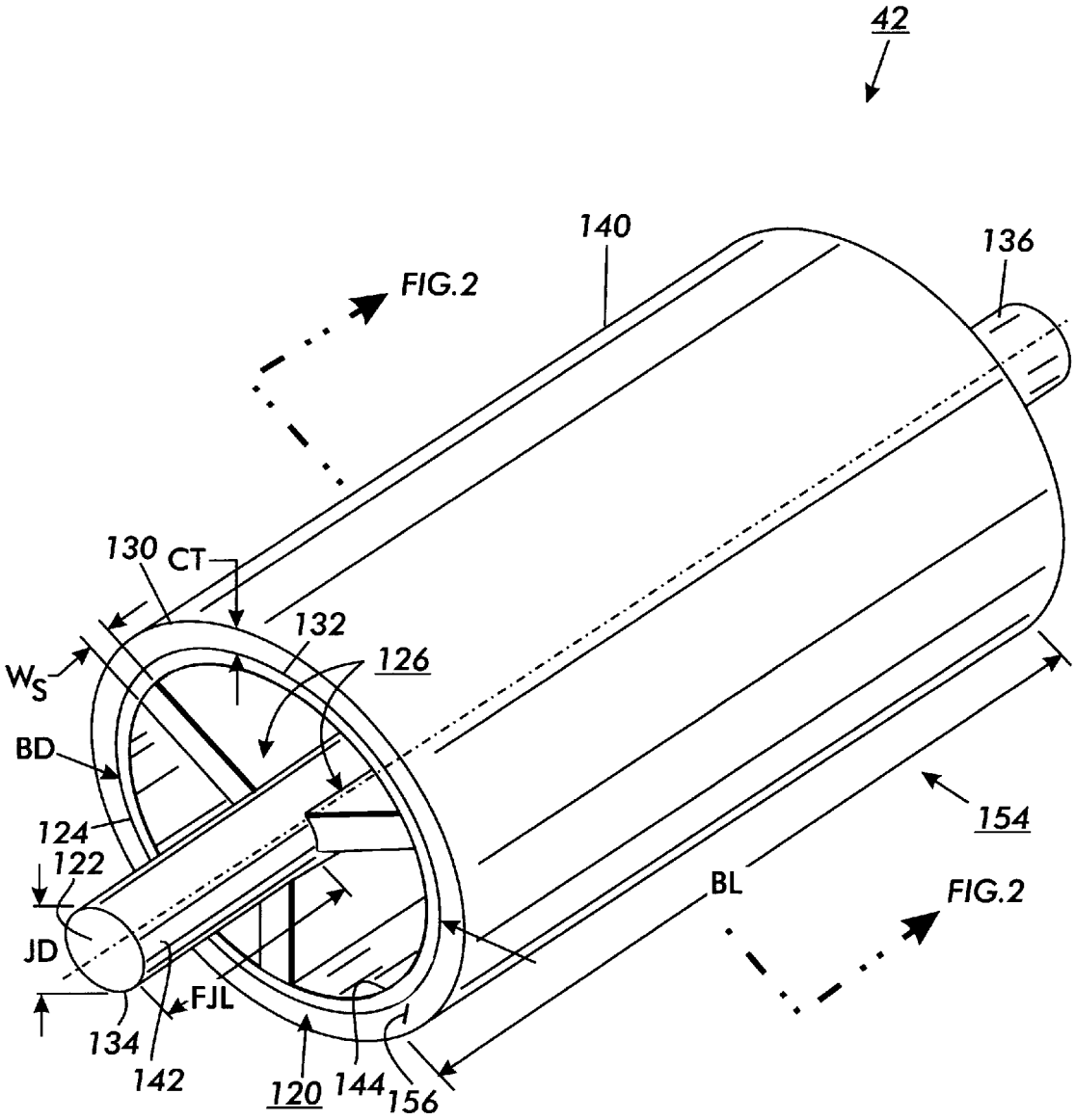
FIG. 1 is a perspective view of a donor roll for use in the FIG. 4 development apparatus including a donor roll with an integral support member according to the present invention.

According to the present invention and referring to FIG. 1, a development roller 42 in the form of a donor roller is shown. The donor roll 42 includes conductive body 120. The conductive body 120 includes a central portion 122 and a peripheral portion 124 which is spaced from the central portion 122. The conductive body 120 further includes a support structure 126 which interconnects the peripheral portion 124 to the central portion 122. The donor roll 42 further includes a semiconductive material 130 which is supplied to an outer periphery 132 of the peripheral portion 124 of the conductive body 120.

While it should be appreciated that the conductive body 120 may be fabricated from separate components which represent respectively the central portion 122, the support structure 126 and the peripheral portion 124 of the conductive body 120. For example, the central portion 122 may be fabricated from a solid cylindrical shaft. The peripheral portion 124 may be fabricated from a cylindrical tube. The support structure 126 may be fabricated from, for example, bars or sheets of material. If the conductive body 120 is fabricated, the conductive body 120 may be assembled by any suitable assembly method. For example, the components of the conductive body 120 may be welded, glued or interferentially fitted to each other.

Preferably, however, the conductive body 120 is manufactured from a one-piece construction. In other words, the central portion 122, the peripheral portion 124, and the support structure 126 are formed of a continuous material. One such method of obtaining a one-piece construction for the conductive body 120 of the developer roll is by providing an extrusion which includes the central portion 122, the support structure 126 and the peripheral portion 124.

While the body 120 may have any suitable shape and be made of any suitable, durable conductive material, preferably, the body 120 is made of a ductile material, for example, a metal which may be easily formed. Aluminum represents a conductive material that is readily formed into the shape as shown in FIG. 1.

Different methods of obtaining the conductive body 122, as shown in FIG. 1, may be practiced when utilizing the present invention. Preferably, however, the conductive body 120 is formed by an extrusion method. When extruded, the conductive body 120 is formed by passing the material, for example aluminum, through an extrusion die. Thereby the conductive body 120 has a uniform cross-section. Thus, the developer roll 42 of the present invention preferably is made from a material having a uniform cross-section.

While the central portion 122 of the conductive body 120 may have any suitable shape capable of practicing the invention, preferably, the central portion 122 has a solid cylindrical shape. The solid cylindrical shape of the central portion 122 is chosen because the central portion 122 is utilized to form a first journal 134 and a second journal 136 for rotatably supporting the donor roller 42. Since the donor roller 42 rotates about the first journal 134 and the second journal 136, a cylindrical center portion 122 may be most easily formed into a cylindrical journal 134 and 136.

The peripheral portion 124 of the conductive body 120 of the donor roller 42 may have any suitable shape capable of including an outer periphery 132 which is cylindrical. The outer periphery 132 of the peripheral portion 124 is cylindrical so that the conductive body 120, when the semiconductive material is applied thereto, may form a cylindrical outer periphery 140 advancing the developer material toward the wire assembly 90. (See FIG. 4). Preferably, for simplicity and to provide for the cylindrical outer periphery 132, the peripheral portion 124 is preferably in the form of a hollow cylinder.

The support structure 126 may have any suitable shape capable of interconnecting and supporting the peripheral portion 124 about the central portion 122 of the conductive body 120. However, for simplicity and to minimize material, the support structure 126 is preferably in the form of a series of members extending from outer periphery 142 of the central portion 122 toward inner periphery 144 of the peripheral portion 124. For simplicity, the members 126 have a uniform thickness and extend outwardly in a radial direction from the outer periphery 142 of the central portion 122 to the inner periphery 144 of the peripheral portion 124. The members 126 thus form spokes to support the peripheral portion 124.

While it should be appreciated that any number of spokes 126 maybe utilized to assist in forming the conductive body 120, preferably, for simplicity and maximum strength with minimum weight, three equally spaced spokes 126 are utilized. For simplicity, as shown in FIG. 1, the spokes 126 have a uniform width $W_S$ of, for example, 0.52 to 1.0 mm. It should be appreciated that the spokes 126 may have a varying thickness rather than a solitary thickness $W_S$. In fact, maximum rigidity at minimum weight may suggest that the width $W_S$ adjacent the outer periphery 142 of the central portion 122 is greater than the thickness Ws near the peripheral portion 124.

Figure 2:
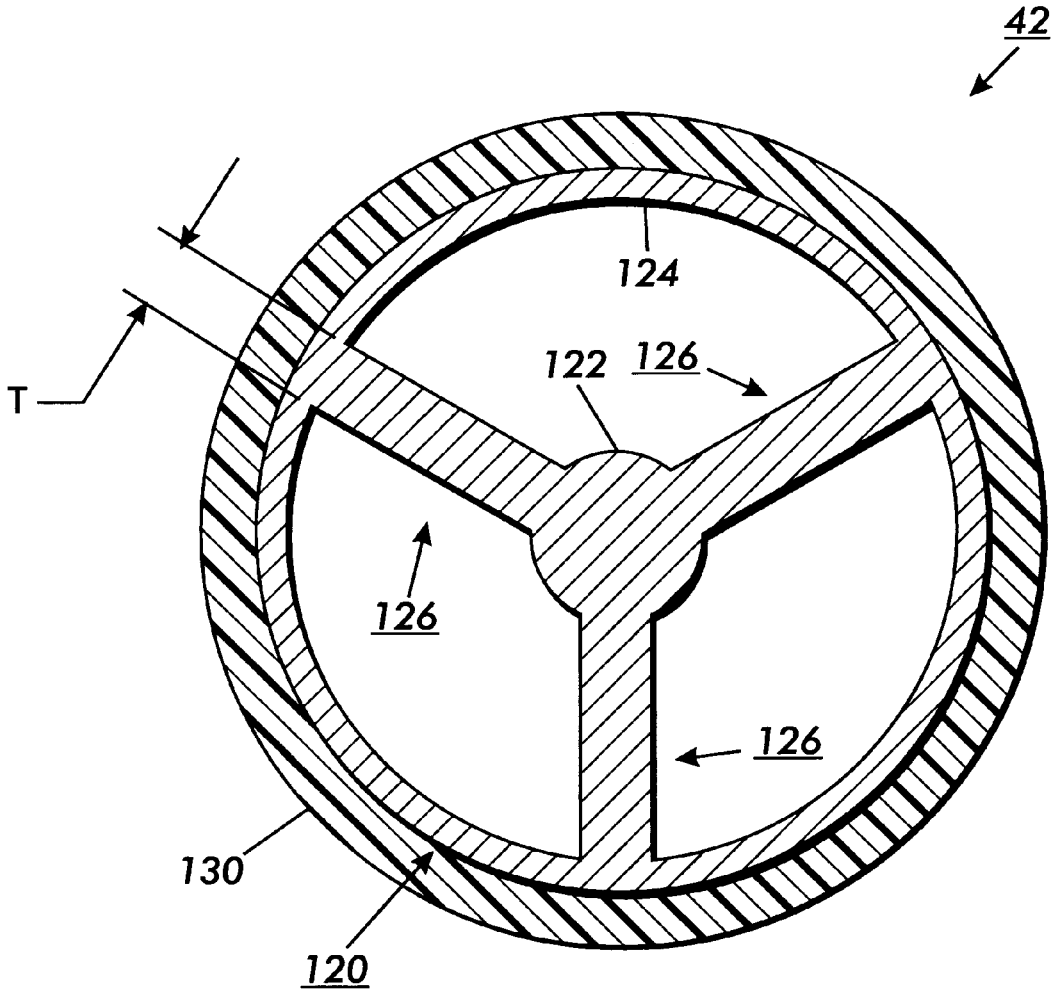
FIG. 2 is a cross sectional view of the donor roll of FIG. 1 along the line 2—2 in the direction of the arrows.

Referring now to FIG. 2, the donor roll 42 is shown in greater detail as a cross-section thereof. The donor roll cross-section as shown in FIG. 2 includes the conductive body 120 and the semiconductive material 130 applied thereon. Preferably, and as shown in FIG. 2, the conductive body 120 is made of a one-piece construction. Thus, the spokes 126 extend continuously between the peripheral portion 124 and the central portion 122.

Figure 3:
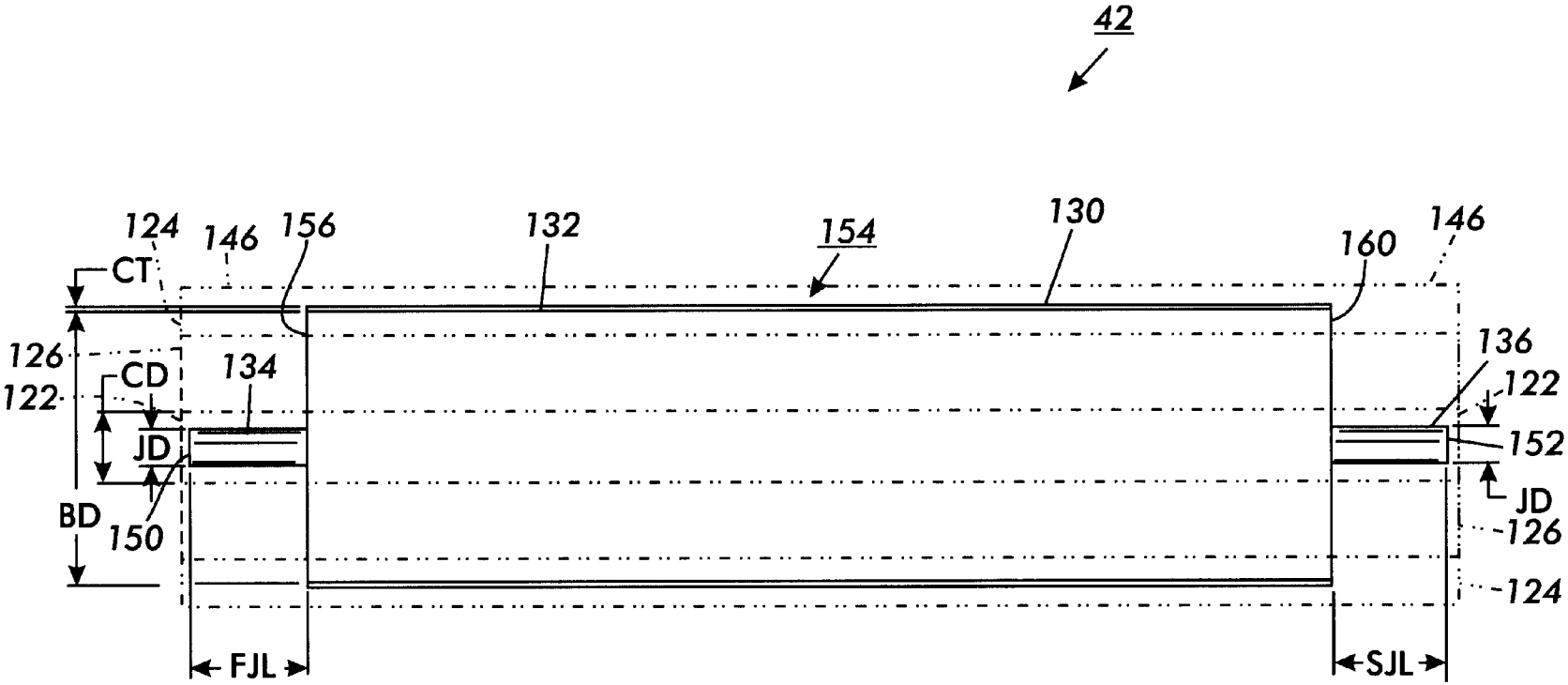
FIG. 3 is a plan view of the donor roll of FIG. 1.

Referring now to FIG. 3, the donor roll 42 is shown with removed portion 146 of the conductive body 120 in phantom. Since, preferably, the donor roll 42 is manufactured with a conductive body 120 having a uniform cross-section as shown in FIG. 2 for the entire length of the donor roll 42, the journals must be formed on the donor roll 42 by machining at least a portion of the conductive body 120 from the opposed ends of the conductive body 120 of the donor roller 42. This portion of the conductive body 120 that is removed is shown in Phantom as the removed portion 146.

Thus, as shown in FIG. 3, material is removed from first end 150 of the conductive body 120 by any suitable method. For example, and generally to minimize cost, the conductive body 120 is rotated on a lathe, for example, a numerically controlled lathe, and the removed portions 146 are machined from the conductive body 120. The peripheral portion 124 of the donor roll 42 is removed from the first end 150 of the conductive body 120 for a distance FJL of say, for example, 8.5 to 25.0 mm.

The spokes 126 are likewise machined and removed for a distance FJL from the first end 150 of the conductive body 120, a distance of, for example, 8.5 to 25.0 mm.

The central portion 122 of the conductive body 120 is machined from first end 150 of the conductive body 120, a distance FJL to a diameter JD which is slightly smaller than diameter CD of the central portion 122 of the conductive body 120 as extruded. For example, the central portion may have a diameter CD of, for example, 6 to 10 mm. The journal diameter JD may be, for example, 0.5 to 2.0 mm smaller than the diameter CD of the central portion 122.

Similarly, the second journal 136 is formed from the conductive body 120 by removing the removed portion 146 from second end 152 of the conductive body 120. The removed portion 146 is removed in any suitable fashion, for example by turning the conductive body 120 on a lathe until the central portion 122 of the conductive body 120 reaches a diameter JD of, for example, 6 mm to 10 mm. The second journal 136 may have a diameter JD as well as a length SJL from the second end 152 of the conductive body 120 of, for example 8.5 to 25.0 mm.

As shown in FIG. 3, the machining of the conductive body 120 forms the donor roller 42 into a body portion 154 from which the first journal 134 and second journal 136 extend from first body end 156 and second body end 160, respectively. The body 154 may have any suitable size capable of providing marking particles for the developer unit 34 (see FIG. 5).

Referring again to FIG. 1, for example, the body 154 may have a length BL capable of providing marking particles at least the width of a sheet of paper, for example 8.5 inches. For example, the body 154 may have a length BL of 200 to 300 mm. The body 154 also has a diameter BD capable of providing a rigid, durable donor roller 42. For example, the body 154 may have a diameter BD of 20 to 40 mm.

The semiconductive material 130 preferably is applied to the outer periphery 132 of the body 154. The semiconductive material 130 may be made of any suitable semiconductive material having suitable semiconductive properties. For example, the semiconductive material 130 may be in the form of an anodization of the aluminum conductive body 120. Such an anodized coating is described in U.S. Pat. No. 4,868,600. Preferably, however, the semiconductive material 130 is in the form of a semiconductive ceramic. Such a semiconductive ceramic has a thickness CT of, for example, 0.002 to 0.040 inches. The ceramic semiconductive material which is suitable for this application is more fully described in U.S. Pat. No. 5,473,418 to Kazakos et al. issued Dec. 5, 1995, the relative portions thereof incorporated herein by reference.

A donor roll 42 may be manufactured by turning the outer periphery 132 of the body 154 and machining the first journal 134 and 136. Preferably, however, to obtain the type of accuracy required for the donor roll 42, the outer periphery 132 of the body 154 may require subsequent machining after the journals 134 and 136 are machined. For example, after the journals 134 and 136 are machined, as earlier described, the body 154 may be then coated with the semiconductive material 130 (for example, a ceramic). The donor roll 42 may then be rotated about the journals 134 and 136 and outer periphery 140 of the roll 42 may then be ground. For suitable operation of the donor roll in a scavengeless development system as that described in U.S. Pat. No. 4,868,600, the periphery 140 of the roll 42 may require a runout of 25 microns or less.

By providing a donor roll with a conductive body including a central portion spaced from a peripheral portion by a support structure, a simple, low cost, reliable and accurate donor roll can be provided.

By providing a donor roll including a conductive body having a central portion spaced from a peripheral portion by a support structure manufactured with a uniform cross-section from an extruded material, a simple low cost and reliable roll can be provided.

By providing a development roller with a conductive body including a central portion spaced from a peripheral portion by a plurality of spaced apart spokes with the central portion, the peripheral portion and the spokes being of a one-piece construction, a simple, inexpensive roll can be manufactured which has improved accuracy, greater reliability and lower cost.

By providing a development roller made with a central portion and a spaced apart peripheral portion made of a one-piece construction and by machining the peripheral portion down to the central portion, a simple, inexpensive and reliable roll may be provided.

It is, therefore, apparent that there has been provided in accordance with the present invention, a guard that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A development roller for use in a machine in which marking particles are advanced toward a latent image to form a developed image, said development roller comprising:

a conductive body, said conductive body including a central portion, a peripheral portion spaced from the central portion, and a support structure including a plurality of members spaced apart and interconnecting the peripheral portion to the central portion; and a semiconductive material applied to an outer periphery of said conductive body.

2. A development roller according to claim 1, wherein said central portion, said peripheral portion, and said support structure have a one piece construction.

3. A development roller according to claim 2, wherein said central portion has a generally cylindrical shape.

4. A development roller according to claim 2, wherein said body comprises a uniform cross section.

5. A development roller according to claim 4:

wherein said body is made from an extruded material; and wherein said semiconductive material comprises at least one of a ceramic, a plastic and an anodized material.

6. A development roller according to claim 1, wherein said central portion of said conductive body extends outwardly from opposed ends of the peripheral portion of said conductive body.

7. A development unit for use in a printing machine in which marking particles are advanced toward a latent image to form a developed image, said development unit comprising:

a housing defining a chamber therein for storing a supply of marking particles therein, said housing defining an aperture therein; and a development roller rotatably mounted to said housing and positioned adjacent the aperture, said development roller adapted to advance said marking particles from the chamber toward the latent image, said development roller including a conductive body, said conductive body including a central portion, a peripheral portion spaced from the central portion, and a support structure including a plurality of members spaced apart and interconnecting the peripheral portion to the central portion, said development roller also including a semiconductive material applied to an outer periphery of said conductive body.

8. A development unit according to claim 7, wherein said central portion, said peripheral portion, and said support structure have a one piece construction.

9. A development unit according to claim 8, wherein said central portion has a generally cylindrical shape.

10. A development unit according to claim 8, wherein said body comprises a uniform cross section.

11. A development unit according to claim 10:

wherein said body is made from an extruded material; and wherein said semiconductive material comprises at least one of a ceramic, a plastic and an anodized material.

12. A development unit according to claim 7, wherein said central portion of said conductive body extends outwardly from opposed ends of the peripheral portion of said conductive body.

13. An electrophotographic printing machine of the type in which marking particles are advanced toward a latent image to form a developed image, said printing machine including a development unit, said development unit comprising:

a housing defining a chamber therein for storing a supply of marking particles therein, said housing defining an aperture therein; and a development roller rotatably mounted to said housing and positioned adjacent the aperture, said development roller adapted to advance said marking particles from the chamber toward the latent image, said development roller including a conductive body, said conductive body including a central portion, a peripheral portion spaced from the central portion, and a support structure including a plurality of members spaced apart and interconnecting the peripheral portion to the central portion, said development roller also including a semiconductive material applied to an outer periphery of said conductive body.

14. A printing machine according to claim 13, wherein said central portion, said peripheral portion, and said support structure have a one piece construction.

15. A printing machine according to claim 14, wherein said central portion has a generally cylindrical shape.

16. A printing machine according to claim 14, wherein said body comprises a uniform cross section.

17. A printing machine according to claim 16:

wherein said body is made from an extruded material; and wherein said semiconductive material comprises at least one of a ceramic, a plastic and an anodized material.

18. A printing machine according to claim 13, wherein said central portion of said conductive body extends outwardly from opposed ends of the peripheral portion of said conductive body.

19. A development roller for use in a machine in which marking particles are advanced toward a latent image to form a developed image, said development roller comprising:

a conductive body having a uniform cross section and being made from an extruded material, said conductive body including a central portion having a generally cylindrical shape, a peripheral portion spaced from the central portion, and a support structure interconnecting the peripheral portion to the central portion, said support structure having a one piece construction, said support structure including three equally spaced apart spokes, each spoke having a similar uniform width, said central portion of said conductive body extending outwardly from opposed ends of the peripheral portion of said conductive body; and a semiconductive material applied to an outer periphery of said conductive body, said semiconductive material including at least one of a ceramic, a plastic and an anodized material.

20. A development roller for use in a machine in which marking particles are advanced toward a latent image to form a developed image, said development roller comprising:

a conductive body, said conductive body including a central portion, a peripheral portion spaced from the central portion, and a support structure interconnecting the peripheral portion to the central portion; and a semiconductive material applied to an outer periphery of said conductive body;

wherein said central portion, said peripheral portion, and said support structure have a one piece construction, wherein said body comprises a uniform cross section, and wherein said support structure comprises a plurality of spaced apart spokes.

21. A development roller for use in a machine in which marking particles are advanced toward a latent image to form a developed image, said development roller comprising:

a conductive body, said conductive body including a central portion, a peripheral portion spaced from the central portion, and a support structure interconnecting the peripheral portion to the central portion; and a semiconductive material applied to an outer periphery of said conductive body;

wherein said central portion, said peripheral portion, and said support structure have a one piece construction, wherein said body comprises a uniform cross section, and wherein said support structure comprises three equally spaced apart spokes, each spoke having a similar uniform width.

22. A development unit for use in a printing machine in which marking particles are advanced toward a latent image to form a developed image, said development unit comprising:

a housing defining a chamber therein for storing a supply of marking particles therein, said housing defining an aperture therein; and a development roller rotatably mounted to said housing and positioned adjacent the aperture, said development roller adapted to advance said marking particles from the chamber toward the latent image, said development roller including a conductive body, said conductive body including a central portion, a peripheral portion spaced from the central portion, and a support structure interconnecting the peripheral portion to the central portion, said development roller also including a semiconductive material applied to an outer periphery of said conductive body;

wherein said central portion, said peripheral portion and said support structure have a one piece construction, wherein said body comprises a uniform cross section, and wherein said support structure comprises a plurality of spaced apart spokes.

23. A development unit for use in a printing machine in which marking particles are advanced toward a latent image to form a developed image, said development unit comprising:

a housing defining a chamber therein for storing a supply of marking particles therein, said housing defining an aperture therein; and a development roller rotatably mounted to said housing and positioned adjacent the aperture, said development roller adapted to advance said marking particles from the chamber toward the latent image, said development roller including a conductive body, said conductive body including a central portion, a peripheral portion spaced from the central portion, and a support structure interconnecting the peripheral portion to the central portion, said development roller also including a semiconductive material applied to an outer periphery of said conductive body;

wherein said central portion, said peripheral portion, and said support structure have a one piece construction, wherein said body comprises a uniform cross section, and wherein said support structure comprises three equally spaced apart spokes, each spoke having a similar uniform width.

24. An electrophotographic printing machine of the type in which marking particles are advanced toward a latent image to form a developed image, said printing machine including a development unit, said development unit comprising:

a housing defining a chamber therein for storing a supply of marking particles therein, said housing defining an aperture therein; and a development roller rotatably mounted to said housing and positioned adjacent the aperture, said development roller adapted to advance said marking particles from the chamber toward the latent image, said development roller including a conductive body, said conductive body including a central portion, a peripheral portion spaced from the central portion, and a support structure interconnecting the peripheral portion to the central portion, said development roller also including a semi-conductive material applied to an outer periphery of said conductive body;

wherein said central portion, said peripheral portion and said support structure have a one piece construction, wherein said body comprises a uniform cross section, and wherein said support structure comprises a plurality of spaced apart spokes.

25. An electrophotographic printing machine of the type in which marking particles are advanced toward a latent image to form a developed image, said printing machine including a development unit, said development unit comprising:

a housing defining a chamber therein for storing a supply of marking particles therein, said housing defining an aperture therein; and a development roller rotatably mounted to said housing and positioned adjacent the aperture, said development roller adapted to advance said marking particles from the chamber toward the latent image, said development roller including a conductive body, said conductive body including a central portion, a peripheral portion spaced from the central portion, and a support structure interconnecting the peripheral portion to the central portion, said development roller also including a semi-conductive material applied to an outer periphery of said conductive body;

wherein said central portion, said peripheral portion and said support structure have a one piece construction, wherein said body comprises a uniform cross section, and wherein said support structure comprises three equally spaced apart spokes, each spoke having a similar uniform width.

* * * * *